US007765914B2

(12) United States Patent
Adler et al.

(10) Patent No.: US 7,765,914 B2
(45) Date of Patent: Aug. 3, 2010

(54) DISPLACER UNIT WITH A VALVE PLATE BODY

(75) Inventors: Robert Adler, Gerasdorf (AT); Georg Siebert, Vienna (AT)

(73) Assignee: Linde Aktiengesellschaft, Munich (DE)

( * ) Notice: Subject to any disclaimer, the term of this patent is extended or adjusted under 35 U.S.C. 154(b) by 1 day.

(21) Appl. No.: 11/997,729

(22) PCT Filed: Jul. 25, 2006

(86) PCT No.: PCT/EP2006/007331

§ 371 (c)(1),
(2), (4) Date: May 28, 2008

(87) PCT Pub. No.: WO2007/014675

PCT Pub. Date: Feb. 8, 2007

(65) Prior Publication Data

US 2008/0246222 A1 Oct. 9, 2008

(30) Foreign Application Priority Data

Aug. 4, 2005 (DE) ..... 10 2005 036 773

(51) Int. Cl.
*F04B 1/12* (2006.01)

(52) U.S. Cl. ..... 91/481; 417/270; 417/269; 91/499

(58) Field of Classification Search ..... 417/269, 417/270, 213; 91/499, 505, 481; 92/57; 277/379

See application file for complete search history.

(56) References Cited

U.S. PATENT DOCUMENTS

| | | | | |
|---|---|---|---|---|
| 4,481,867 | A * | 11/1984 | Nagase et al. | 91/487 |
| 5,085,127 | A | 2/1992 | Gantzer | |
| 5,108,268 | A * | 4/1992 | Divall | 417/269 |
| 5,109,754 | A * | 5/1992 | Shaw | 91/499 |
| 5,279,205 | A * | 1/1994 | Carlson et al. | 91/485 |
| 5,295,809 | A * | 3/1994 | Dresler et al. | 417/366 |
| 2003/0147757 | A1 * | 8/2003 | Kanno et al. | 417/269 |

FOREIGN PATENT DOCUMENTS

| | | |
|---|---|---|
| CH | 348322 | 8/1960 |
| DE | 199 30 411 | 1/2000 |
| WO | WO 2005/035980 A1 | 4/2005 |

OTHER PUBLICATIONS

Pending Patent Application, titled "Engine", Inventors Robert Adler, et al., filed Feb. 1, 2008.

* cited by examiner

*Primary Examiner*—Devon C Kramer
*Assistant Examiner*—Todd D Jacobs
(74) *Attorney, Agent, or Firm*—Crowell & Moring LLP

(57) ABSTRACT

A displacer unit with a valve plate body is disclosed. The displacer unit having at least one displacer space which is arranged in a cylindrical drum rotating about an axis of rotation and which can be connected to an inlet connection and an outlet connection by a control surface. The control surface is formed on a valve plate body which is provided with a first control opening, which is connected to the inlet connection, and with a second control opening, which is connected to the outlet connection. The first control opening and the second control opening are spaced apart radially, where the displacer space can be connected to the first control opening by a first connecting passage and to the second control opening by a second connecting passage. The connecting passages are provided with a respective mechanical face seal for sealing relative to the control openings.

22 Claims, 3 Drawing Sheets

DISPLACER UNIT WITH A VALVE PLATE BODY

This application claims the priority of International Application No. PCT/EP2006/007331, filed Jul. 25, 2006, and German Patent Document No. 10 2005 036 773.9, filed Aug. 4, 2005, the disclosures of which are expressly incorporated by reference herein.

BACKGROUND AND SUMMARY OF THE INVENTION

The invention relates to a displacer unit having at least one displacer space which is arranged in a cylindrical drum rotating about an axis of rotation and which can be connected to an inlet connection and an outlet connection by means of a control surface, wherein the control surface is formed on a valve plate body which is provided with a first control opening, which is connected to the inlet connection, and with a second control opening, which is connected to the outlet connection.

With generic displacer units, which can be operated as compressors or motors, the alternating connection of the displacer spaces arranged in the rotating cylindrical drum is guaranteed with the inlet opening and outlet connection embodied on the housing by means of the control surface. The control surface is embodied on a valve plate body, which is provided with a kidney-shaped control opening that is connected to the inlet opening, and a kidney-shaped control opening that is connected to the outlet connection. The control openings in this case are arranged on a common divided circle.

The rotating cylindrical drum in this case is adjacent to the stationary valve plate body, whereby each displacer space has a connecting opening for connection to the control openings. A flat seal is provided between the connecting opening and the control openings.

In the case of these types of displacer units, hydrostatic relief is provided to reduce the friction that arises on the flat seal. The hydrostatic relief, however, produces leakage flows between the inlet side and the outlet side, as well as from the inlet side and from the outlet side to the housing interior. In addition, a pressure medium flow occurs between the displacer spaces. The flat seal continues to show evidence of increased leakage flow already with slight damage or wear. Because of these leakage flows, operation of the displacer unit is restricted to a specific maximum operating pressure. Generic displacer units are therefore not suited for operating the displacer unit at high maximum operating pressures, in particular pressures of up to 1000 bar, because of the increasing leakage flows and the associated poor efficiency.

The present invention is based on the objective of making available a displacer unit of the species cited at the outset, which has low leakage flows and therefore is suitable for operation at high maximum operating pressures.

This objective is attained in accordance with the invention in that the first control opening and the second control opening are spaced apart radially, wherein the displacer space can be connected to the first control opening by means of a first connecting passage and to the second control opening by means of a second connecting passage, and the connecting passages are provided by means of a respective mechanical face seal for sealing relative to the control opening. According to the invention, the control openings of the valve plate body are thus arranged on separate divided circles and the displacer space can be connected to the corresponding control opening by means of two connecting passages arranged on separate divided circles, wherein the displacer spaces are sealed by means of the mechanical face seals instead of a flat, prior art seal. This type of seal, using mechanical face seals, makes it possible to effectively avoid leakage flows between the displacer spaces and leakage flows between the inlet side and the outlet side, as well as from the inlet side and the outlet side to the housing interior. The inventive displacer unit is thereby suited for operation at high maximum operating pressures of in particular up to 1000 bar, and has a high efficiency in this case.

According to a preferred embodiment of the invention, the mechanical face seal is embodied as a mechanical face bushing. By using annular mechanical face bushings, it is possible to seal the connecting passages of the displacer spaces in a simple manner relative to the control openings arranged in the valve plate body.

The mechanical face seal can be acted upon with special advantage by means of a spring in the direction of the valve plate body. The mechanical face seals embodied as mechanical face bushings are thus pretensioned by the spring and are pressed on the control surface by the spring. This allows a secure abutment of the mechanical face bushing on the valve plate body—and thus a secure seal—to be achieved.

According to a preferred development of the connection, the mechanical face seals are provided with a control surface acting in the valve plate body direction, wherein the control surface can be acted upon by the pressure available in the connecting passage. This allows the pressure available in the displacer space to also act on the mechanical face seals embodied as mechanical face bushings, and thus the mechanical face bushings, to act on the control openings as a function of the available operating pressure so that, when operating the displacer unit at high operating pressures, a secure seal of the displacer spaces relative to the control openings is achieved resulting in low leakage flows.

A simple structure with low manufacturing expenses can be achieved with the connecting passages provided with mechanical face seals, if the mechanical face seal is arranged in a bore-shaped recess of the connecting passage.

A preferred embodiment of the invention provides that the mechanical face seals are sealed relative to the recess by means of an O-ring. This allows a leakage flow between the recess and the mechanical face bushing to be prevented effectively and with low construction expense.

Particular advantages are produced if, according to a development of the invention, a sealing device is provided for sealing the first control opening relative to the second control opening and/or a sealing device for sealing the first control opening relative to a housing interior and/or a sealing device for sealing the second control opening relative to the housing interior. These types of sealing devices make it possible in a simple way to seal the first control opening relative to the second control opening as well as to seal the first control opening and the second control opening relative to the housing interior and thus to seal the control openings, thereby preventing leakage flows between the control openings and from the control openings to the housing interior, therefore making it possible to operate the displacer unit at high operating pressures and with high efficiency.

In this case, the sealing device is embodied as a mechanical face seal according to a preferred embodiment. The control openings can be sealed in a simple manner with these types of annular mechanical face seals.

If the sealing device, in accordance with an expedient development of the invention, can be acted upon by means of a spring in the direction of the cylindrical drum, it is possible to achieve a secure abutment of the sealing devices embodied as mechanical face seals on the cylindrical drum in order to seal the control openings.

Special advantages are produced if the sealing devices are provided with a control surface acting in the direction of the cylindrical drum. This produces pressure-dependent pressing on the sealing devices embodied as mechanical face seals so that, when operating the displacer unit at high pressures, a secure seal of the control openings among each other and relative to the housing interior is achieved, and therefore, low leakages.

According to a preferred embodiment of the invention, the control surface of the sealing device that seals the first control opening relative to the second control opening, and the control surface of the sealing device that seals the second control opening relative to the housing interior, can be acted upon by the pressure available in the second control opening, and the control surface of the sealing device that seals the first control opening relative to the housing interior can be acted upon by the pressure available in the first control opening. In the case of a displacer unit that is operated as a compressor, in which the first control opening is connected to the inlet opening that is acted upon with low pressure and the second control opening is connected to the outlet connection maintaining the maximum operating pressure, low pressure additionally acts on the sealing device that seals the first control opening relative to the housing interior, and the operating pressure available in the second control opening additionally acts on the sealing device that seals the first control opening relative to the second control opening as well as the sealing device that seals the second control opening relative to the housing interior, thereby achieving a secure seal of the first control opening and the second control opening.

A simple arrangement of the sealing device embodied as mechanical face seals can be achieved with low construction expense if the sealing devices are arranged in an annular free space of the valve plate body.

Leakage flows between the free spaces and the sealing devices can be avoided in a simple way if the sealing device—according to an expedient development of the invention—is sealed relative to the free space by means of an O-ring.

The control openings in this case are embodied expediently as kidney-shaped control openings.

If, according to an advantageous development of the invention, the valve plate body can be rotated relative to the axis of rotation by means of a regulating device, in particular a control piston, it is possible in a simple manner to change the engagement time points of the control openings, and in particular the control opening that is acted upon, with the maximum operating pressure. As a result of this, pressure equalization flows and pressure pulsations, which occur when connecting the displacer space to the control opening maintaining the maximum operating pressure due to the difference in pressure between the displacer space and the pressure available in the control opening, are reduced; whereby, in the case of a displacer unit operated as a compressor, pressure pulsations and pressure equalization flows, which allow the energy consumption of a displacer unit operated as a compressor to rise, can be reduced and avoided.

The displacer unit can be operated as a compressor or as a motor and is suited for operation with liquids as well as with gaseous media, particularly hydrogen.

BRIEF DESCRIPTION OF THE DRAWINGS

Additional advantages and details of the invention are explained in greater detail on the basis of the exemplary embodiment depicted in the schematic figures. The drawings show.

DETAILED DESCRIPTION OF THE DRAWINGS

Figure 1:
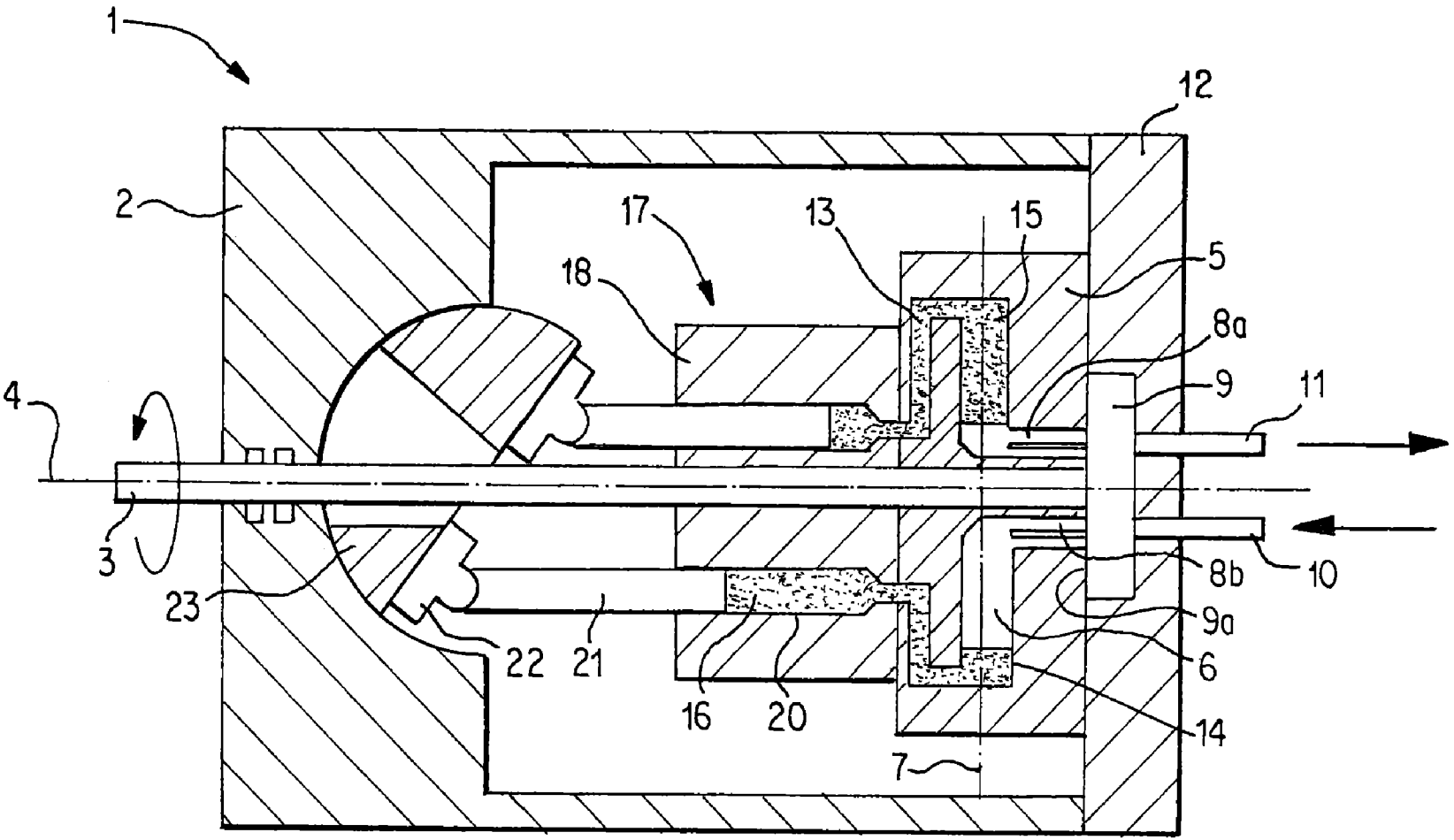
FIG. 1 is a longitudinal section of an inventive engine.

FIG. 1 depicts a longitudinal section of an inventive displacer unit 1. A drive shaft 3 is rotatably mounted within a housing 2 around an axis of rotation 4. A cylindrical drum 5, in which several displacer spaces 6 designed as displacer cylinders are embodied, is coupled to the drive shaft 3 in a rotationally synchronous manner. The displacer spaces 6 in this case are embodied as radial bores 14 arranged in the cylindrical drum 5 and are arranged in a star-shape around the axis of rotation 4, whereby the longitudinal axis 7 of the displacer spaces 6 is arranged perpendicularly to the axis of rotation 4 of the drive shaft 3 and thus of the cylindrical drum 5.

In the radial inner region, the displacer spaces 6 are connected to a first connecting passage 8*a* and a second connecting passage 8*b*, which are spaced apart radially. The connecting passages 8*a*, 8*b* are operatively connected to a plate-shaped valve plate body 9, whereby a control surface 9*a* is embodied on the fore part of valve plate body 9 facing the cylindrical drum 5. Using the control valve 9, it is possible to control the connection of the displacer spaces 6 to an inlet opening 10, as well as an outlet connection 11. The cylindrical drum 5 in this case is supported in the axial direction on the valve plate 9, which is arranged on a housing cover 12 fastened to the housing 2.

A liquid 15, in particular an ionic liquid, is arranged in the displacer spaces 6.

Each displacer space 6 is connected by means of a connecting passage 13 to a cylinder space 16 of a hydraulic displacer unit 17 embodied as an axial piston machine having a diagonal plate design. In this case, the displacer unit 17 embodied as an axial piston machine has a cylinder block 18, which is arranged coaxially to the cylindrical drum 5 and is connected to the cylindrical drum 5 and/or the drive shaft 3 in a rotationally fixed manner. It is also possible to embody the cylinder block 18 and the cylindrical drum 5 as a common and therefore one-piece cylindrical drum.

The cylinder spaces 16 of the axial piston machine are formed by the longitudinal bores 20 arranged concentrically in the cylinder block 18, in which bores pistons 21 are respectively arranged in a longitudinally displaceable manner. The pistons 21 are each supported on a diagonal plate 23 by means of a sliding block 22. A spherical sliding block articulation is embodied between the piston 21 and sliding block 22.

The axial piston machine is embodied as an axial piston machine whose displacer volume can be adjusted, whereby the diagonal plate 23 is swivel-mounted on the housing 2 and can be inclined with respect to the axis of rotation 4 by means of a regulating device (not shown). However, it is also possible to embody the axial piston machine with a fixed displacer volume, whereby the diagonal plate can be embodied directly on the housing 2.

In this case, the cylindrical drum 5 and the displacer unit 17 are arranged in the common housing.

In the case of an embodiment of the inventive displacer unit 1 as a compressor, the cylindrical drum 5 and the cylinder block 18 are driven via the drive shaft 3. In this case, the axial piston machine functions as a pump and conveys liquid 15 from the cylinder spaces 16 to the displacer spaces 6, whereby the medium flowing into the displacer cylinder 6 via the inlet connection 10 maintaining low pressure is compressed by the liquid 15 and conveyed to the outlet connection 11 maintaining the operating pressure.

In the case of an embodiment of the inventive engine 1 as a drive motor, pressurized medium is supplied to the displacer spaces 6 via the inlet opening 10 maintaining the operating pressure. The liquid 15 acts on the pistons 21, whereby the axial piston machine is operated as motor and a rotational movement of the cylindrical drum 5 and of the cylinder block 18 is generated, whereby torque can be tapped on the drive shaft 3.

Figure 2:
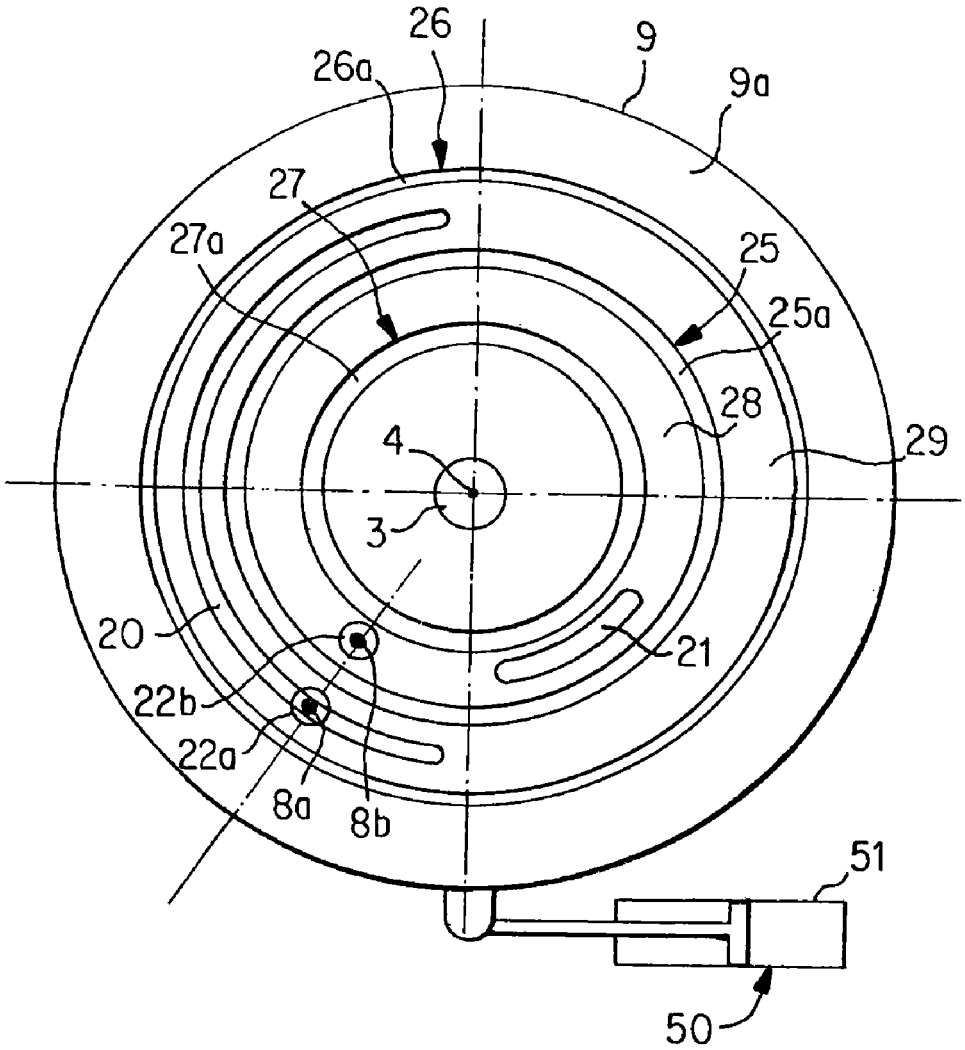
FIG. 2 is a top view of the control surface.

FIG. 2 shows the valve plate body 9 in a top view of the control surface 9*a*. The valve plate body 9 has a first control opening 20, which is designed in a kidney-shaped manner and is connected to the inlet opening. A second control opening 21, which is also designed in a kidney-shaped manner and is embodied on the valve plate body 9, is connected to the outlet connection.

The control openings 20, 21 in this case are arranged spaced apart radially on different divided circles. In this case, the first connecting passage 8*a* connected to the displacer space triggers the first control opening 20. The second connecting passage 8*b* triggers the second control opening 21.

Mechanical face seals 22*a*, 22*b* for sealing the connecting passage 8*a*, 8*b* relative to the control openings 20, 21 are arranged on the first connecting passage 8*a* and the second connecting passage 8*b* respectively.

A sealing device 25, which is formed by an annular mechanical face seal 25*a*, is provided to seal the first control opening 20 relative to the second control opening 21.

The first control opening 20 is sealed relative to the housing interior by means of another sealing device 26, which is embodied as an annular mechanical face seal 26*a*. A further sealing device 27, which is embodied as an annular mechanical face seal 27*a*, is provided to seal the second control opening 21 relative to the drive shaft 3 and thus relative to the housing interior.

An annular space 28, into which the second control opening 21 discharges, is embodied between the radial inner sealing device 27 and the radial center sealing device 25. The annular space 28 is thus acted upon by the pressure available at the second control opening 21. Another annular space 29, into which the first control opening 20 discharges, is formed between the radial outer sealing device 26 and the radial center sealing device 25, whereby the annular space 29 is acted upon by the pressure available at the control opening 20.

The valve plate body 9 is operatively connected to a regulating device 50, which is embodied as a control cylinder 51, for example. This device can be used to rotate the valve plate body 9 with respect to the axis of rotation 4.

Figure 3:
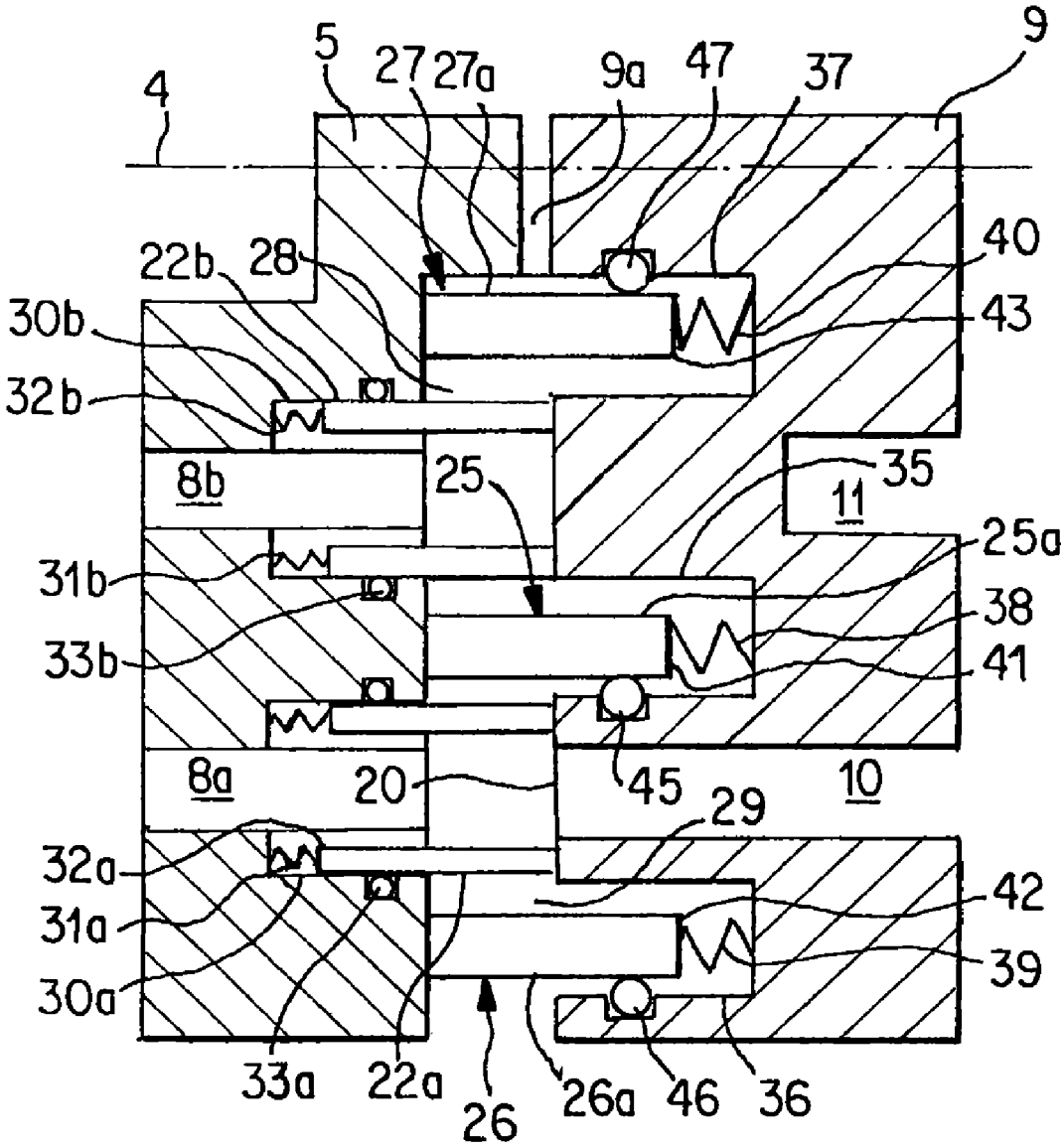
FIG. 3 is an enlarged representation of the side view of the control surface.

As FIG. 3 shows, the mechanical face seals 22*a*, 22*b* of the connecting passages 8*a*, 8*b* are embodied as mechanical face bushings, which are respectively arranged in a bore-shaped recess 30*a*, 30*b* of the connecting passage 8*a*, 8*b*. The mechanical face seals 22*a*, 22*b* are acted upon in the direction of the valve plate body 9 by means of springs 31*a*, 31*b* arranged in the recess 30*a*, 30*b*. Embodied on the left front side of the mechanical face seals 22*a*, 22*b* in FIG. 3 is a control surface 32*a*, 32*b*, which acts on the mechanical face seals 22*a*, 22*b* in the direction of the valve plate body 9. The control surfaces 32*a*, 32*b* in this case is acted upon by pressure available in the connecting passage 8*a*, 8*b*. The connecting passages 8*a*, 8*b* are sealed with respect to the annular spaces 28, 29 by means of an O-ring 33*a*, 33*b*, which is arranged between the recess 30*a*, 30*b* and the mechanical face seals 22*a*, 22*b*.

The sealing devices 25, 26, 27 are embodied as annular mechanical face seals 25*a*, 26*a*, 27*a*, which are arranged in annular free spaces 35, 36, 37 of the valve plate body 9. In this case, a spring 38, 39, 40, which is arranged in the corresponding free spaces 35, 36, 37, acts on each of the mechanical face seals 25*a*, 26*a*, 27*a* in the direction of the cylindrical drum 5. Embodied on the right front sides of the mechanical face seals 25*a*, 26*a*, 27*a* in FIG. 3 are control surfaces 41, 42, 43 acting in the direction of the cylindrical drum 5. The control surface 41 embodied on the sealing device 25 and the control surface 43 embodied on the sealing device 27 are acted upon in this case by the pressure available in the annular space 28 and thus at the control opening 21. The control surface 42 embodied on the sealing device 26 is acted upon by the pressure available in the annular space 29 and thus in the control opening 20.

An O-ring 45, which seals the annular space 28 from the annular space 29, is arranged on the radial outer area of the sealing device 25 between the sealing device 25 and free space 35.

Another O-ring 46 is arranged on the radial outer area of the sealing device 26 between the sealing device 26 and the free space 36. The O-ring 46 seals the annular space 29 relative to the housing interior.

An O-ring 47, which seals the annular space 28 relative to the housing interior in the area of the drive shaft, is arranged on the radial inner area of the sealing device 27 between free space 37 and the sealing device 27.

When operating the inventive displacer unit 1 as a compressor, low pressure acts on the inlet opening 10. The outlet connection 11 is acted upon by the operating pressure generated. Thus, low pressure is available in the annular space 29, which is connected to the inlet opening 10 via the first control opening 20. The annular space 28, which is connected to the outlet connection 11 via the second control opening 21, is acted upon by the high pressure generated. The connection of the first control opening 20 to the displacer space 6 is controlled by the connecting passage 8*a*, whereby a seal is achieved via the mechanical face seal 22*a*. The second control opening 21 is connected to the displacer space 6 via the connecting passage 8*b*, wherein a seal is achieved by means of the mechanical face seal 22*b*. In addition to the springs 31*a*, 31*b*, the mechanical face seals 22*a*, 22*b* in this case are acted upon in the direction of the valve plate body 9 by the pressure available in the displacer space 6. The second control opening 21 in this case is dimensioned in such a way that always only one displacer space 6 is connected to the control opening 21. In this case, the mechanical face seal 22*b* prevents a leakage flow from the displacer space 6 connected to the control opening 21 to the adjacent displacer spaces.

A leakage flow from the first control surface 20 to the second control surface 21 is prevented by the sealing device 25, which is acted upon in the direction of the cylindrical drum 5 by the spring 38 and by the operating pressure available at the control surface 41.

The leakage flow from the second control surface 21 to the housing interior in the area of the drive shaft 3 is prevented by the sealing device 27, which, in addition to the spring 40, is acted upon in the direction of the cylindrical drum by the operating pressure available at the control surface 43.

The leakage flow from the first control surface 20 to the housing interior is prevented by the sealing device 26, which is acted upon in the direction of the cylindrical drum 5 by the spring 39 and by the low pressure, which is available at the control surface 42.

Therefore, the mechanical face seals 22*a*, 22*b* as well as the sealing devices 25, 26, 27 embodied as mechanical face seals 25*a*, 26*a*, 27*a* can effectively prevent leakage flow between the displacer spaces 6 as well as leakage flow between the control openings 20, 21, as well as leakage flow from the control openings 20, 21 to housing interior.

Because of the reduced leakage flows, the inventive displacer unit 1 is suitable for operation at high maximum operating pressures, in particular for operating pressures of up to 1000 bar, wherein the displacer unit that is operated as a compressor has a low energy consumption and high efficiency. As a result, the inventive displacer unit that is operated as a compressor can be used for compressing gaseous media, particularly hydrogen.

The invention claimed is:

1. A displacer unit having a displacer space which is arranged in a cylindrical drum rotating about an axis of rotation and which is connectable to an inlet connection and an outlet connection by a control surface, wherein the control surface is formed on a valve plate body which is provided with a first control opening, which is connectable to the inlet connection, and with a second control opening, which is connectable to the outlet connection, wherein the first control opening and the second control opening are spaced apart radially, wherein the displacer space is connectable to the first control opening by a first connecting passage and to the second control opening by a second connecting passage, wherein the first control opening and the first connecting passage are arranged at a first radial distance from an axis of rotation of the valve plate body, wherein the second control opening and the second connecting passage are arranged at a second radial distance from the axis of rotation of the valve plate body, wherein the first radial distance is greater than the second radial distance, and wherein the connecting passages are provided with respective mechanical face seals for sealing relative to the control openings.

2. The displacer unit according to claim 1, wherein the mechanical face seals are embodied as a mechanical face bushing.

3. The displacer unit according to claim 1, wherein the mechanical face seals are acted upon by means of respective springs in a direction of the valve plate body.

4. The displacer unit according to claim 1, wherein the mechanical face seals are each provided with a control surface acting in a direction of the valve plate body.

5. The displacer unit according to claim 4, wherein the control surfaces are acted upon by a pressure available in a respective connecting passage.

6. The displacer unit according to claim 1, wherein the mechanical face seals are each arranged in a bore-shaped recess of a respective connecting passage.

7. The displacer unit according to claim 6, wherein the mechanical face seals are sealed relative to the recesses by means of an O-ring.

8. The displacer unit according to claim 1, wherein a first sealing device is provided for sealing the first control opening relative to the second control opening and a second sealing device is provided for sealing the first control opening relative to a housing interior and a third sealing device is provided for sealing the second control opening relative to the housing interior.

9. The displacer unit according to claim 8, wherein the sealing devices are embodied as a mechanical face seal.

10. The displacer unit according to claim 8, wherein the sealing devices are acted upon by respective springs in a direction of the cylindrical drum.

11. The displacer unit according to claim 8, wherein the sealing devices are provided with a control surface acting in a direction of the cylindrical drum.

12. The displacer unit according to claim 11, wherein the control surface of the first sealing device that seals the first control opening relative to the second control opening and the control surface of the third sealing device that seals the second control opening relative to the housing interior are acted upon by a pressure available in the second control opening and the control surface of the second sealing device that seals the first control opening relative to the housing interior is acted upon by a pressure available in the first control opening.

13. The displacer unit according to claim 8, wherein the sealing devices are arranged in an annular free space of the valve plate body.

14. The displacer unit according to claim 13, wherein the sealing devices are sealed relative to the free space by means of an O-ring.

15. The displacer unit according to claim 1, wherein the control openings are embodied as kidney-shaped control openings.

16. The displacer unit according to claim 1, wherein the valve plate body is rotatable relative to the axis of rotation by a regulating device.

17. The displacer unit according to claim 1, wherein the displacer unit is a compressor.

18. The displacer unit according to claim 1, wherein the displacer unit is a motor.

19. The displacer unit according to claim 1, wherein a liquid flows through the inlet connection and the outlet connection.

20. The displacer unit according to claim 1, wherein a gaseous media flows through the inlet connection and the outlet connection.

21. The displacer unit according to claim 20, wherein the gaseous media is hydrogen.

22. A displacer unit, comprising:

a rotatable cylindrical drum, wherein the cylindrical drum defines a displacer space with an inlet connection and an outlet connection; and a valve plate body coupled to the cylindrical drum, wherein the valve plate body defines a first control opening connectable to the inlet connection and a second control opening connectable to the outlet connection;

wherein the displacer space is connectable to the first control opening by a first connecting passage and to the second control opening by a second connecting passage;

wherein the first control opening and the first connecting passage are arranged at a first radial distance from an axis of rotation of the valve plate body, wherein the second control opening and the second connecting passage are arranged at a second radial distance from the axis of rotation of the valve plate body, and wherein the first radial distance is greater than the second radial distance;

and further wherein the inlet connection and the outlet connection each include a mechanical face seal that engages with the valve plate body.

* * * * *